US006003621A

United States Patent [19]

Murray

[11] Patent Number: 6,003,621

[45] Date of Patent: Dec. 21, 1999

[54] METHODS AND APPARATUS FOR DRILLING HOLES LATERALLY FROM A WELL

[75] Inventor: James W. Murray, Palm Desert, Calif.

[73] Assignee: Directional Recovery Systems LLC, Palm Desert, Calif.

[21] Appl. No.: 08/920,951

[22] Filed: Aug. 29, 1997

Related U.S. Application Data

[62] Division of application No. 08/425,431, Apr. 20, 1995, Pat. No. 5,704,437.

[51] Int. Cl.[6] ..... E21B 7/08

[52] U.S. Cl. ..... 175/79; 175/61; 166/117.5

[58] Field of Search ..... 175/61, 81, 79, 175/82, 73, 203, 276; 166/117.6, 117.5, 242.1, 242.5

[56] References Cited

U.S. PATENT DOCUMENTS

| | | | |
|---|---|---|---|
| 4,007,797 | 2/1977 | Jeter | 175/26 |
| 4,397,355 | 8/1983 | McLamore | 166/117.6 X |
| 4,640,353 | 2/1987 | Schuh | 166/117.6 X |
| 5,117,912 | 6/1992 | Young | 166/305.1 |
| 5,277,251 | 1/1994 | Blount et al. | 166/117.5 |
| 5,335,737 | 8/1994 | Baugh | 166/117.6 Y |
| 5,429,187 | 7/1995 | Beagrie et al. | 166/117.5 X |
| 5,452,759 | 9/1995 | Carter et al. | 166/117.6 |
| 5,499,680 | 3/1996 | Walter et al. | 166/117.6 X |
| 5,704,437 | 1/1998 | Murray . | |

OTHER PUBLICATIONS

Advertising sheet of Baker Oil Tools labeled "Permanent Packer Systems".

Booklet of A–Z/Grant International entitled "Casing Side-track Systems".

Advertising sheet of A–Z/Grant International entitled"Side-track Systems A–Z Pack–Stock".

Article entitled "Slimhole Norizontal Re–Entries Provide Alternative To New Drills" from the Nov. 1992 issue of Petroleum Engineer International.

Advertising sheet entitled "SS–WS Whipstock Packer With Anchor".

Article "SPE 26714 Slim–Hole and Coiled–Tubing Window Cutting Systems".

Advertising sheet of Slimdril International, Inc. entitled "Advanced Slimdril Positive Displacement Drilling Motors".

Advertising sheet of Eastman Christensen entitled "Special Products & Services".

Advertising sheet of Eastman Christensen entitled "Drilling Systems & Services".

Advertising sheet entitled "Chisel–Type Deflection Wedge and Drill–Off Tool".

Document entitled "A–Z/Grant International Company—Operation Procedure For The Pack–Stock And Anchor–Stock", pp. 1 thru 29.

*Primary Examiner*—Frank S. Tsay

*Attorney, Agent, or Firm*—Darby & Darby, P.C.

[57] ABSTRACT

An apparatus for enhancing production from a well by lowering a tubular conductor into the well to a position in which the conductor extends downwardly from near the surface of the earth to a zone beneath the surface, and a drilling unit is advanced past a whipstock held by the tubular conductor at the predetermined zone, thereby deflecting the drilling unit in a lateral direction through an opening in a side wall of the conductor into the earth formation about the conductor. The whipstock may initially be attached to the drilling unit by a shear connection. An anchor may lock the lower end of the tubular conductor in place in the well, with a rotatively adjustable connection enabling rotation of the tubular conductor to different rotary positions for producing holes in the formation in different directions. A second whipstock may be lowerable into the tubular conductor to direct liners from within the conductor into the holes formed in the formation.

38 Claims, 11 Drawing Sheets

19a
15a
29
29
98
149a
104
28
28
97
96
94
13
106
107
27
27
44a
108
32
32
109
87
33
88
32
13
149a
97
96
95
19a
102
149a
30
30
15a
104
103
13
15a
149a
19a
31
31

METHODS AND APPARATUS FOR DRILLING HOLES LATERALLY FROM A WELL

This is a divisional of prior application Ser. No. 08/425,431 filed Apr. 20, 1995, now U.S. Pat. No. 5,704,437.

This invention relates to apparatus for enhancing the production of oil, gas, or other fluids by drilling a hole or holes laterally into the earth formation about a well,

BACKGROUND OF THE INVENTION

After a well has been in operation for a number of years, the rate of production of oil or other fluids from the well may decrease to a point at which further operation of the well is not economically practical. Under these circumstances, various expedients have been proposed and utilized for enhancing the production and extending the life of the well. One system employed is to drill one or more drain holes laterally from the well into the surrounding earth formation to enable flow of oil or other fluids through those holes into the main well bore and through that bore to the surface of the earth. However, the drilling of laterally extending holes by conventional methods is relatively expensive and may not be warranted in many marginal wells.

Lateral holes may be formed by positioing in a well a whipstock having a deflecting surface engageable with a drill bit or drilling unit to direct that unit laterally from the main well bore into the earth formation. Such a whipstock may be lowered into the well with the drilling unit, and may have an anchor at its lower end for locking the whipstock in place, with the whipstock being attached to the drilling unit by a shear connection which can be broken in the well to allow the drilling unit to move past and be deflected by the whipstock.

SUMMARY OF THE INVENTION

A major purpose of the present invention is to provide improved methods and apparatus for producing holes extending laterally from a well at a production zone in a manner much more expeditiously and inexpensively than has heretofore been possible, to thereby permit even very marginal wells to be brought back to economically feasible production. The invention permits two or more holes to be drilled in different directions sequentially by the same equipment in essentially a single overall operation, and then to be lined in a manner facilitating the flow of oil or other fluid from the holes into the main well bore.

Structurally, apparatus embodying the invention includes a tubular conductor which is lowered into the casing of the depleted or partially depleted well to a zone spaced beneath the surface of the earth, and which is adapted to hold a whipstock at a desired location deep within the well for deflecting a drilling unit laterally from within the tubular conductor, to drill a hole in the casing of the well and into the surrounding earth formation. The tubular conductor preferably has an opening in its side wall through which the drilling unit is deflected by the whipstock. An orienting structure is carried in the lower end of the tubular conductor and is engageable by the whipstock upon lowering of the whipstock within the conductor, to orient the whipstock rotatively in a position facing in a desired direction. The whipstock may initially be connected to the drilling unit by a shear connection for lowering of these two parts into the tubular conductor together, and with the drilling unit being contained within a tubular housing extending above the whip-stock. An anchor at the lower end of the tubular conductor locks the conductor in place in the well, and is connected to the tubular conductor by a rotatively adjustable connection enabling the conductor to be turned between different positions for drilling of two or more holes in different directions into the formation. An additional connection between the anchor and tubular conductor may be detachable to permit the conductor to be withdrawn upwardly from the well after the drilling operation has been completed.

After one hole has been drilled through the casing and into the formation, the whipstock and drilling unit may be withdrawn from the conductor, and a liner then be lowered through the conductor and into the lateral hole, with a liner hanger forming a connection between the liner and the original casing of the well. The liner and hanger may be directed to their proper positions by a second whipstock which may be connected to the liner and hanger and be lowered into the tubular conductor therewith.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
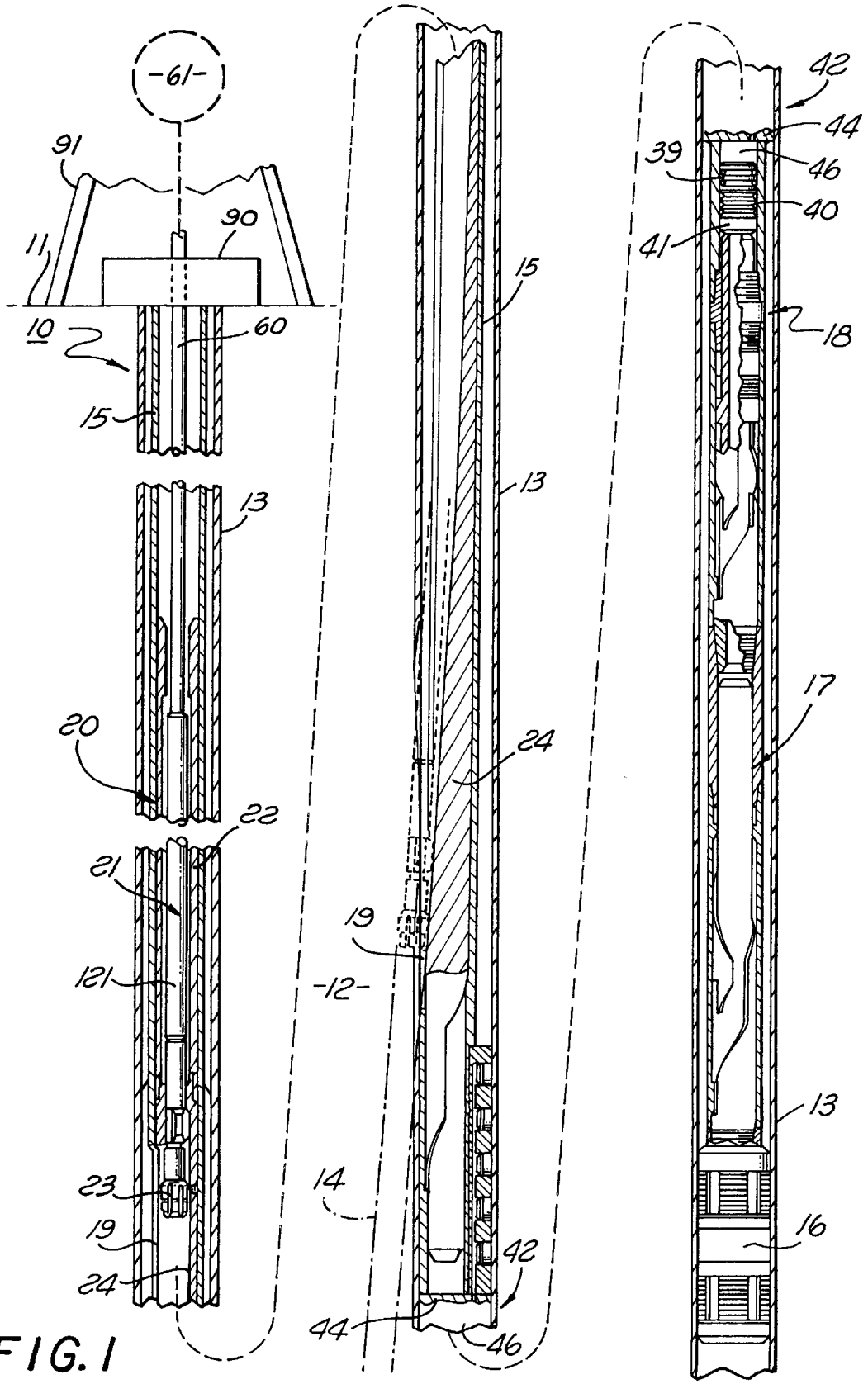
FIG. 1 is a somewhat diagrammatic view illustrating an overall arrangement of a first form of well drilling system embodying the invention.

Referring first to FIG. 1, there is illustrated at 10 in that figure a well extending downwardly from the surface of the earth 11 to a zone 12 deep within the earth from which oil, gas or another fluid is to be produced. The well is lined along its entire vertical extent by a conventional casing 13. The well 10 may typically be one which has been in production for several years, and whose rate of production has gradually decreased to a point at which it may no longer be economically feasible to continue operation of the well. In order to increase the production from the well, the apparatus of the present invention is utilized to drill one or more holes laterally from the casing into the surrounding earth formation, as represented for example in broken lines at 14 in the central figure of FIG. 1.

The equipment utilized for drilling such laterally extending holes into the formation includes an elongated vertical string of pipe 15, which may be referred to as a conductor, and which has an external diameter substantially less than the internal diameter of the casing 13 of the well. Conductor 15 is formed in conventional manner of a series of pipe sections threadedly connected together, and is of a length to extend downwardly from the surface of the earth to the bottom of the well. This conductor thus provides a confined vertical passage downwardly into the well through which all of the drilling and lining operations of the invention are performed. Conductor 15 is suspended at its upper end by the usual rotary table 90 of the well drilling rig 91. At its lower end, conductor 15 carries an anchor 16 which may be of conventional construction, and is adapted to engage and grip casing 13 at the bottom of the well, and form a seal therewith. The anchor 16 may be expanded against the casing when it reaches a desired point in the weill, with the expansion being effected by predetermined motion of the conductor, such as by upward movement of the conductor or turning movement. The lower end of conductor 15 is attached to anchor 16 by a releasable connector assembly 17 just above the anchor, and by a rotatively adjustable connection 18 vertically between connector 17 and the lower end of the conductor. Connector 17 allows the entire apparatus to be detached from anchor 16 and removed upwardly from the well after the drilling operation has been completed. Connector 18 allows conductor 15 and its carried apparatus to be rotated in the well to different positions in order to drill holes laterally into the earth formation in different directions. Near its lower end, conductor 15 has a vertically elongated opening 19 formed in its side wall through which a drilling unit advances laterally to drill a hole into the formation. Rotation of the conductor as permitted by rotary connection 18 allows this opening 19 to face in different directions for drilling holes in those different directions.

After conductor 15 and the attached parts have been lowered into the well to the position illustrated in FIG. 1, an assembly 20 is introduced into the upper end of conductor 15, and lowered downwardly through that conductor to its lower end to the point at which the hole is to be drilled. Assembly .20 includes a drilling unit 21 initially contained within a vertical tubular hosing 22 and having a bit 23 at its lower end for drilling the hole. A whipstock 24 of assembly 20 is attached to bit 23 by a shear connection 59, and projects downwardly therefrom, and is adapted to deflect the bit laterally throuah casing 13 and into the earth formation. Drilling unit 21 is of conventional construction, including a vertically elongated small diameter motor 121 adapted to be driven by pressurized mud fed downwardly to the motor, and acting to turn bit 23 to perform a drilling operation. After a hole has been drilled in the earth, assembly 20 including the drilling unit and whipstock are drawn upwardly through conductor 15 to the surface of the earth, and a liner assembly 25 as illustrated in Pigs. 13 to 21 is lowered into the well to line the hole. The tools utilized in setting the liner are then withdrawn from the conductor, after which the conductor is turned to a second position and the drilling and lining operations are repeated for a second hole.

Figure 2:
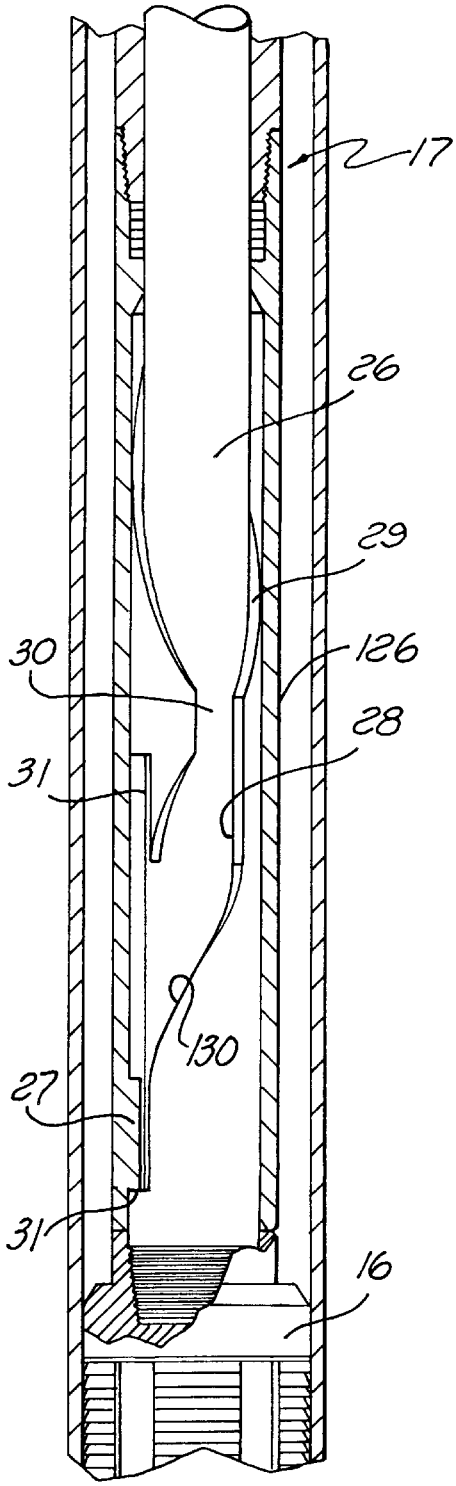
FIG. 2 is a fragmentary vertical section through the lower releasable connection of the FIG. 1 apparatus.

To now describe some of the parts of the apparatus in greater detail, reference is first made to FIG. 2 which shows the construction of detachable connection 17. As seen in that figure, connector 17 includes a mandrel 26 attached rigidly at its lower end to anchor 16 and projecting upwardly therefrom. A sleeve 126 projects downwardly from rotary connection 18 and is receivable about mandrel 26, and has a J-slot type connection therewith. More particularly, sleeve 126 has a lug 27 projecting radially inwardly from its side wall and received within a J-slot 28 formed in the outer surface of mandrel 26. When sleeve 126 is initially moved downwardly about mandrel 26, lug 27 is deflected by helical camming surfaces 29 of the J-slot to enter a passage 30 which extends first vertically downwardly and then helically at 130 to turn the sleeve until lug 27 ultimately reaches a vertically extending portion 31 of the J-slot pattern. When the lug is within vertical portion 31 of the slot pattern, sleeve 126 is free to move vertically relative to mandrel 26 but is not detachable from the mandrel unless the sleeve is turned relative thereto. When it is desired to disconnect conductor 15 and its related equipment from anchor 16, conductor 15 and the connected sleeve 126 are rotated in a counterclockwise direction relative to mandrel 26, enabling lug 27 to move upwardly through the helical passage 30 for separation of sleeve 126 from the mandrel.

Figure 3:
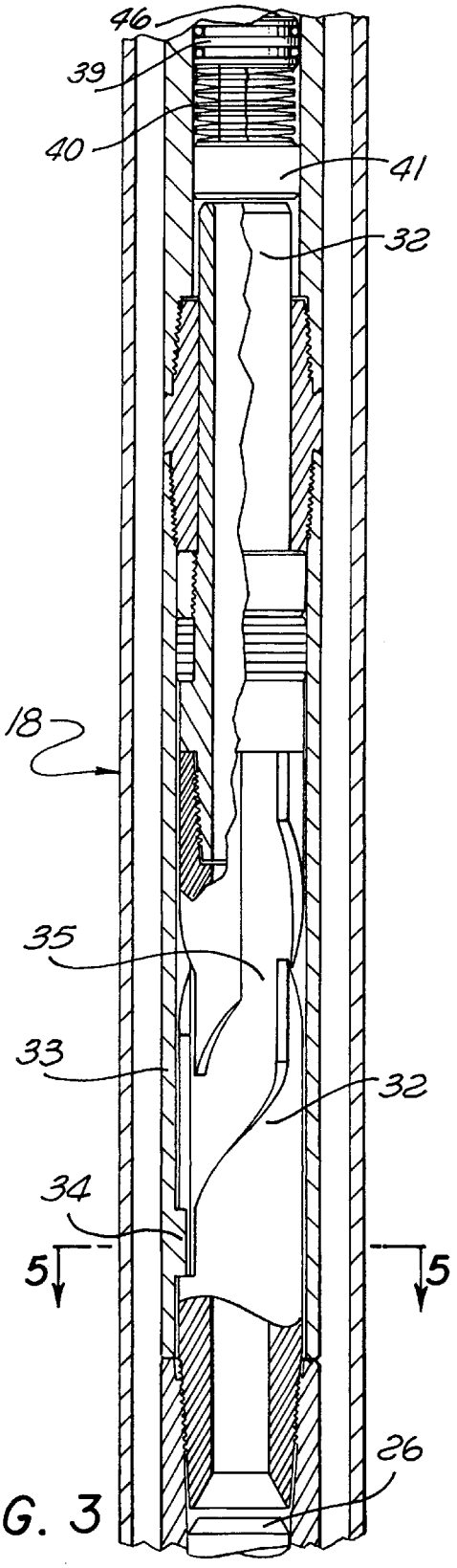
FIG. 3 is a fragmentary vertical section through the rotatively adjustable connection which permits the apparatus to be turned to different positions for drilling holes into the earth formation in different directions.
Figure 6:
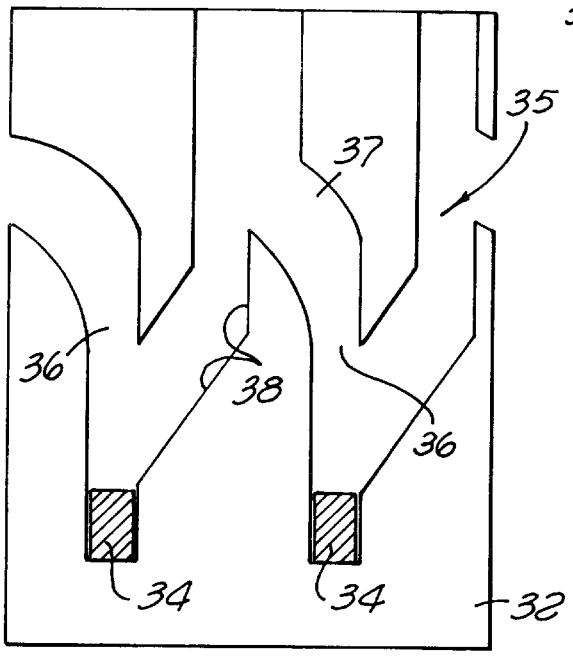
FIG. 6 is a developed view taken on the circular line 6—6 of FIG. 5, looking inwardly toward the axis of the rotatively adjustable connection.

At its upper end, sleeve 126 carries a second upwardly projecting mandrel 32 forming a portion of rotary connection 18 (see FIG. 3), and which is receivable within a sleeve 33 of connection 18. That sleeve 33 has two lugs 34 projecting radially inwardly from its side wall, and received within a circuitous J-slot type groove or recess 35 formed in the outer surface of mandrel 32. This groove 35 may typically have the pattern illustrated in the developed view of FIG. 6. More particularly, if the apparatus is to be designed for drilling two holes in the earth formation in diametrically opposite directions, the J-slot groove or pattern of FIG. 6 may include two vertical portions 36 of the groove at diametrically opposite locations within which lugs 34 are received during drilling of one of the holes. If conductor 15 and sleeve 33 are raised to a point at which lugs 34 reach the upper ends of the vertical passages 36, the sleeve may then be turned through 180 degrees to a changed rotary setting, as permitted by movement of each lug upwardly and rotatively within a portion 37 of the groove and then downwardly and rotatively within a portion 38 to a different one of the vertical grooves 36.

The upper end of sleeve 33 contains a piston 39 which is urged upwardly by springs 40 located between the piston and a part 41 movable vertically in sleeve 33. When an operator allows the weight of conductor 15 and the connected parts to rest downwardly against anchor 16, the limited downward movement of sleeve 33 of connection 18 relative to mandrel 32 of that connection causes part 41 to engage downwardly against the upper end of mandrel 32, in a manner tending to move part 41 upwardly within sleeve 33 and thereby causing springs 40 to move piston 39 upwardly relative to the sleeve. Fluid confined within a chamber 46 within sleeve 33 above the piston is thereby pressurized.

At its upper end, conductor 15 is suspended by rotary table 900. At its lower extremity 42, conductor 15 is offset from the axis 43 of the well and its casing 13, to engage against the casing at one side of conductor 15, and thereby enhance the effectiveness with which the whip-stock can deflect a bit laterally through the casing and into the formation. The bottom of conductor 15 is rigidly attached to a horizontal plate 44 which may be circular and of an external diameter just slightly less than the internal diameter of casing 13. The upper end of sleeve 33 of connection 18 is similarly rigidly attached to the underside of plate 44. The attachment of elements 15 and 33 to plate 44 may be effected by welding of the parts at 45. The pressurized fluid within the chamber 46 above piston 39 is utilized to urge the lower end of conductor 15 and part 44 tightly against the engaged portion of casing 13 by actuation of a number of pistons 47 contained within cylinder bores 48 formed in a part 49 welded to the side of the lower portion of tube 15. The fluid from chamber 46 flows upwardly through a passage 50 in plate 44 and through a passage 51 in part 49 to enter the inner ends of cylinder bores for urging the pistons 47 radially outwardly against the engaged portions of the side wall of casing 13, to thereby press conductor 15 laterally against the opposite portion of the casing. The lower portion of conductor 15 may be further retained and located in its eccentric position within the casing by a number of vertically elongated plates or fins 149 welded to conductor 15 and dimensioned externally to fit fairly closely within the casing but to allow sufficient clearance to permit the assembly to be lowered through the casing.

Figure 4:
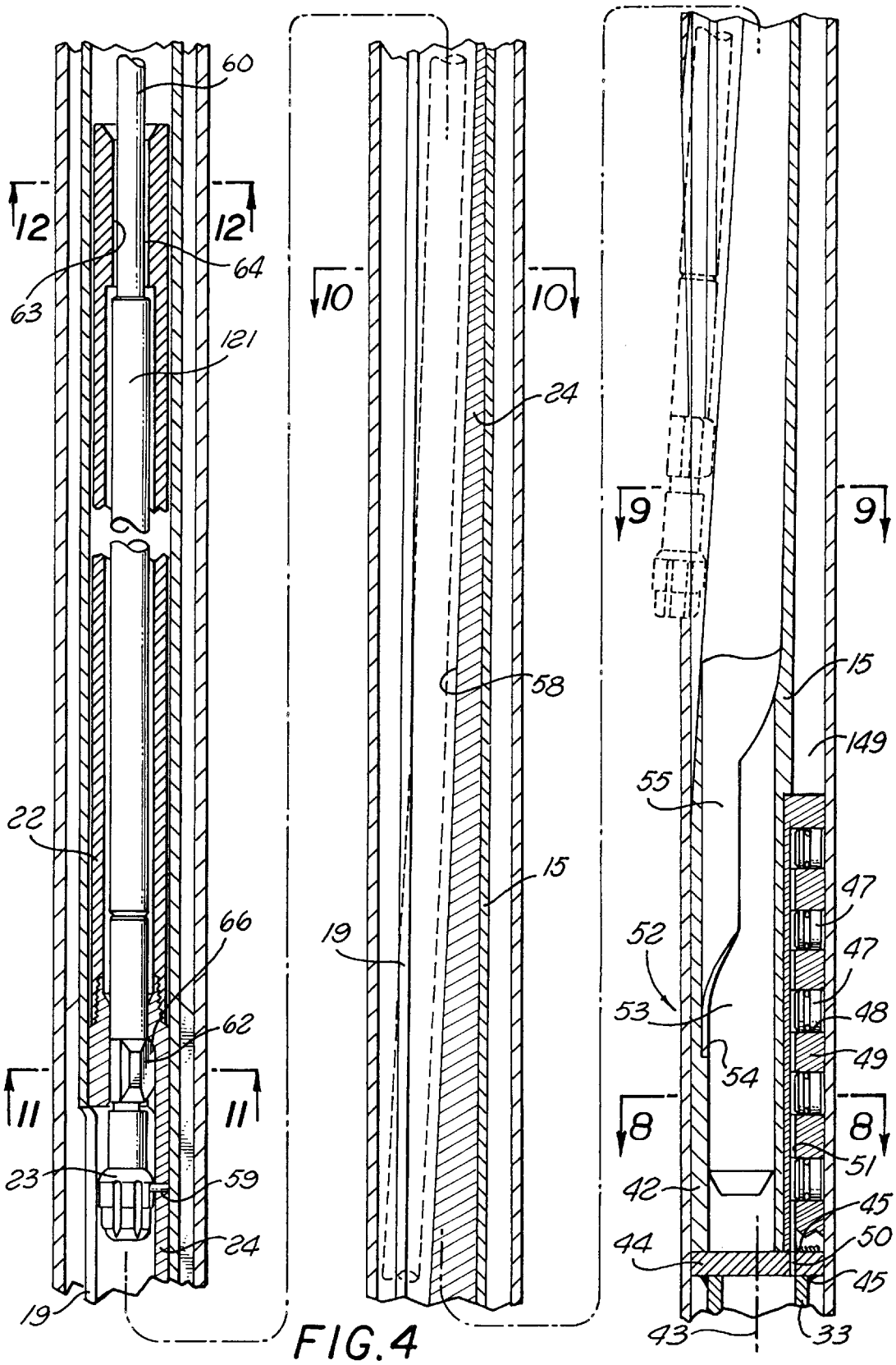
FIG. 4 is a fragmentary vertical section through the whipstock and drilling assembly as they appear just prior to drilling of a hole into the formation.
Figure 5:
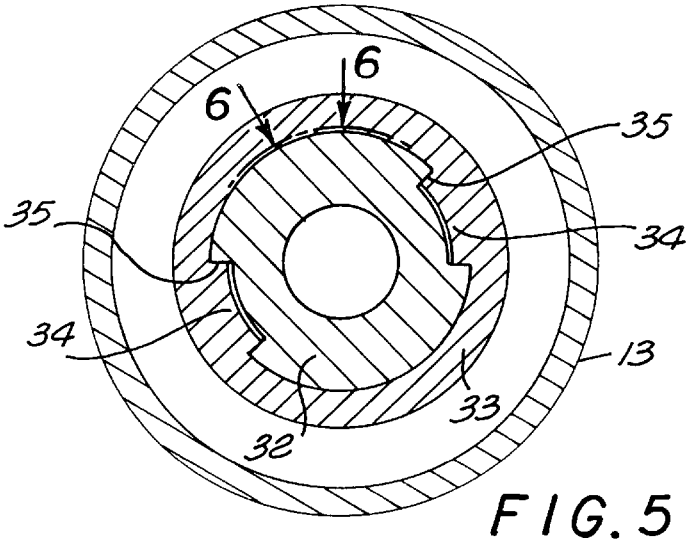
FIG. 5 is a horizontal section taken on line 5—5 of FIG. 3.
Figure 7:
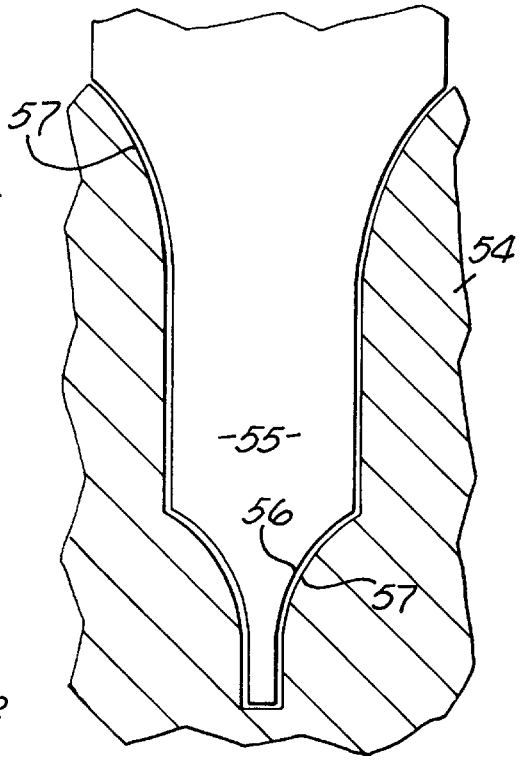
FIG. 7 is a similar developed view, showing the shape of the interfitting orienting portions of the whipstock and conductor for turning the whipstock to a predetermined rotary setting relative to the conductor.
Figure 8:
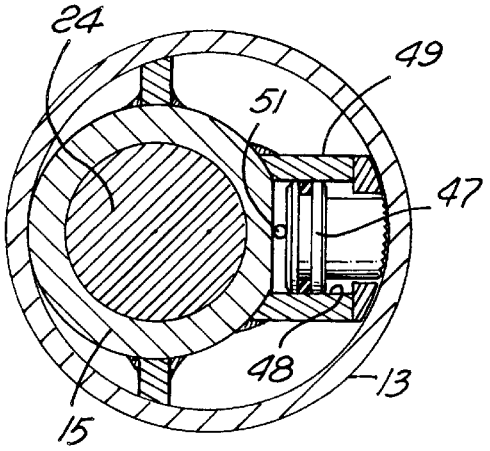
FIGS. 8, 9, 10, 11 and 12 are horizontal sections taken on the lines 8—8, 9—9, 10—10, 11—11 and 12—12 respectively of FIG. 4.
Figure 9:
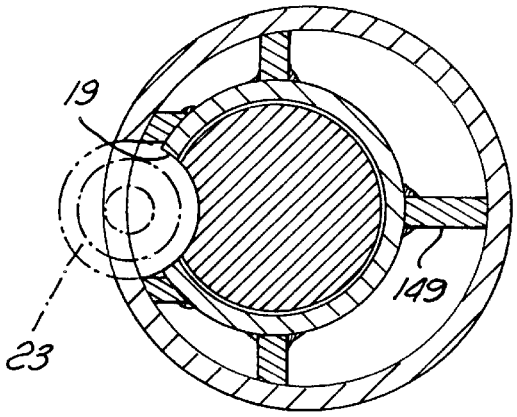
Figure 10:
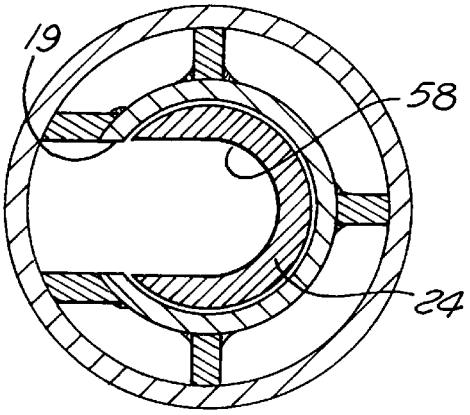
Figure 11:
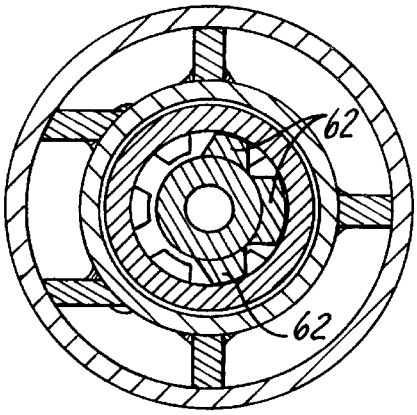

FIG. 4 shows the assembly 20 which includes drilling unit 21, housing 22, bit 23 and whipstock 24, as these parts appear after they have been lowered into conductor 15 to the lower end of that conductor for performing a drilling operation. This assembly 20 is detachably connected to the lower end of conductor 15 by a releasable connection 52 which acts to orient assembly 20 and the whipstock and drilling unit rotatively so that the whipstock faces directly radially outwardly toward opening 19 in the side wall of the conductor, to drill a hole through the casing and formation in the direction in which the opening 19 faces. Connection 52 is formed by reception of a lower orienting mandrel portion 53 of the whipstock within an orienting socket 54 formed within the lower portion of conductor 15. Mandrel 53 has an increased diameter portion 55 on its outer surface shaped in correspondence with a recess 56 formed in the side wall of the lower socket portion 54 of conductor 15, to be received within that recess in only one rotary setting of the whipstock relative to conductor 15. Projection 55 and recess 56 are shaped as shown in the developed view in FIG. 7 to have camming surfaces 57 engageable with one another as the whipstock moves downward relative to part 15, to automatically rotate the whipstock to the proper rotary orientation relative to conductor 15 as mandrel 53 reaches the lower end of socket 54 in conductor 15.

The whipstock has a camming face or surface 58 which is engageable with bit 23 to deflect the bit laterally through opening 19 and through the casing into the earth formation when the bit is advanced downwardly relative to to the whipstock. During lowering of the assembly 20 into the conductor, the bit is attached rigidly to the whipstock by a shear pin 59 (FIG. 4). After the assembly 20 has reached the position illustrated in FIG. 4, the operator releases the weight of a vertical string of pipe 60 which supports assembly 20, to allow the weight of that string to jar bit 23 downwardly in a manner breaking shear pin 59 and allowing the bit to be advanced downwardly past the whipstock and into the formation. The upper end of the bit is connected to the rotor of mud motor 121, to which circulating fluid is delivered through string 60 from a pump 61 at the surface of the earth. The pressure of the mud thus causes rotation of bit 23, so that as it is lowered it will advance outwardly through opening 19 in conductor 15 to drill an opening in the casing and into the formation. As seen in FIG. 4, the non-rotating housing of motor 121 may have wear resistant skids 62 on its outer surface projecting outwardly far enough relative to the diameter of the bit to prevent or minimize damage to the deflecting surface of the whipstock by the bit.

Figure 12:
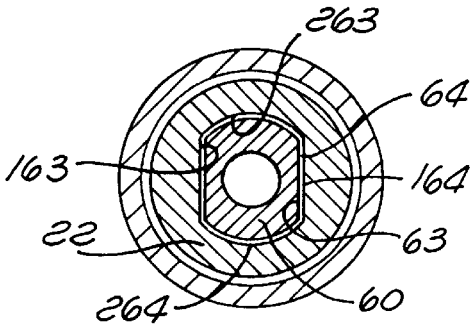

Housing 22 is a tubular structure connected to the upper end of whipstock 24 and of a vertical length sufficient to receive the entire length of motor 121 when the bit is in its retracted position of FIGS. 1 and 4. At its upper end, housing 22 preferably has a portion containing a non-circular opening or passage 63, defined by two parallel planar side wall surfaces 163 and two cylindrically curved surfaces 263 (see FIG. 12). A correspondingly shaped non-circular portion 64 of the string 60 which suspends and supplies fluid to assembly 20 is slidably received within passage 63, having parallel flats 164 at its opposite sides engaging side wall surfaces 163 of the passage to prevent rotation of the string 60 and drilling motor 121 relative to housing 22 or the whipstock, and retain these parts in a fixed rotary position as the motor and bit are advanced downwardly. Because of its flattened configuration, the portion 64 of string 60 can bend more readily in one direction than in a perpendicular direction, to facilitate lateral deflection of the bit and the string along a curving path. Portion. 64 of course bends most readily in the direction of its smaller dimension. The non-circular opening in portion 63 of the upper portion of the housing 22 is oriented so that this natural direction of bend is toward opening 19 in the side of conductor 15. The length of the non-circular portion of string 60 is predetermined to be great enough to allow advancement of the bit laterally into the earth formation as far as is desired. The skids 62 at the lower end of the drilling motor are engageable upwardly against a shoulder 66 in whipstock 24 after a drilling operation has been completed, to allow string 60 to pull the entire assembly 20 including bit 23 and whipstock 24 upwardly from the well.

Figure 13:
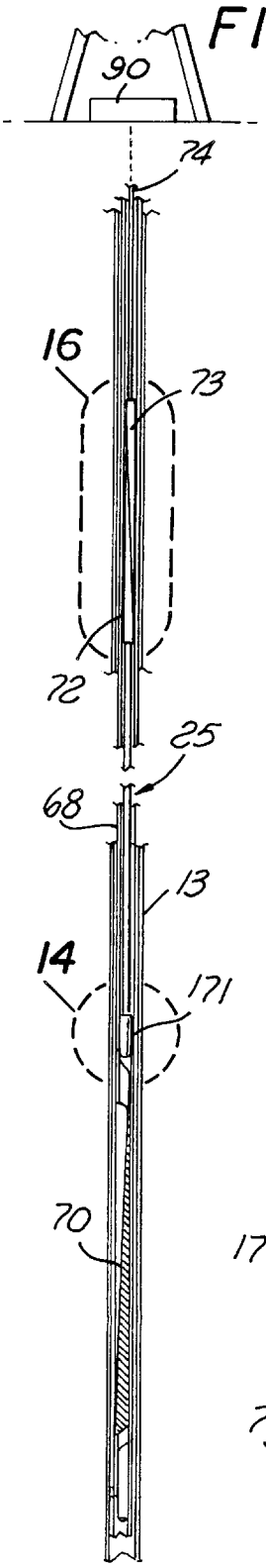
FIG. 13 is a diagrammatic view similar to FIG. 1 but showing the liner running assembly as it is being lowered through the conductor.
Figure 14:
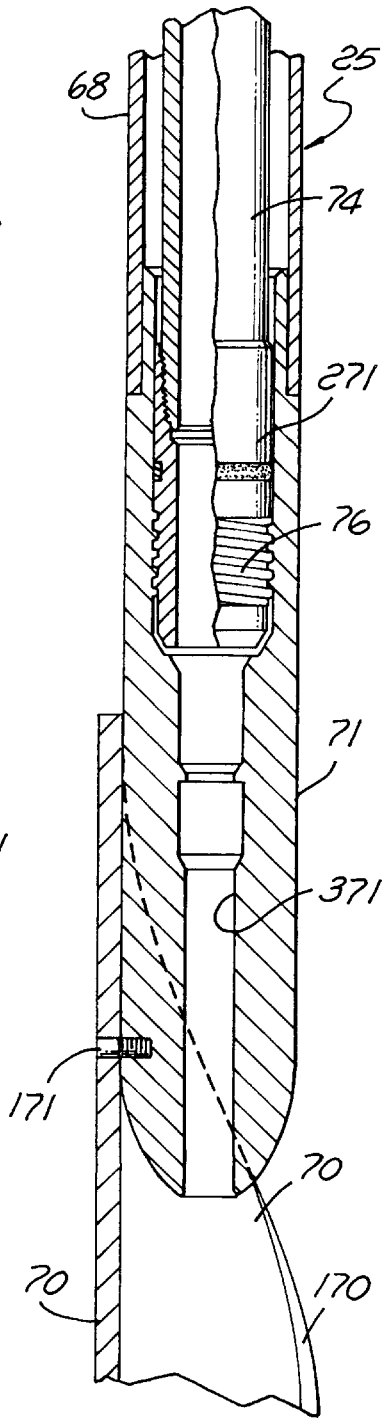
FIG. 14 is an enlarged vertical section through the portion of the apparatus enclosed within the circle identified by the number 14 in FIG. 13.
Figure 15:
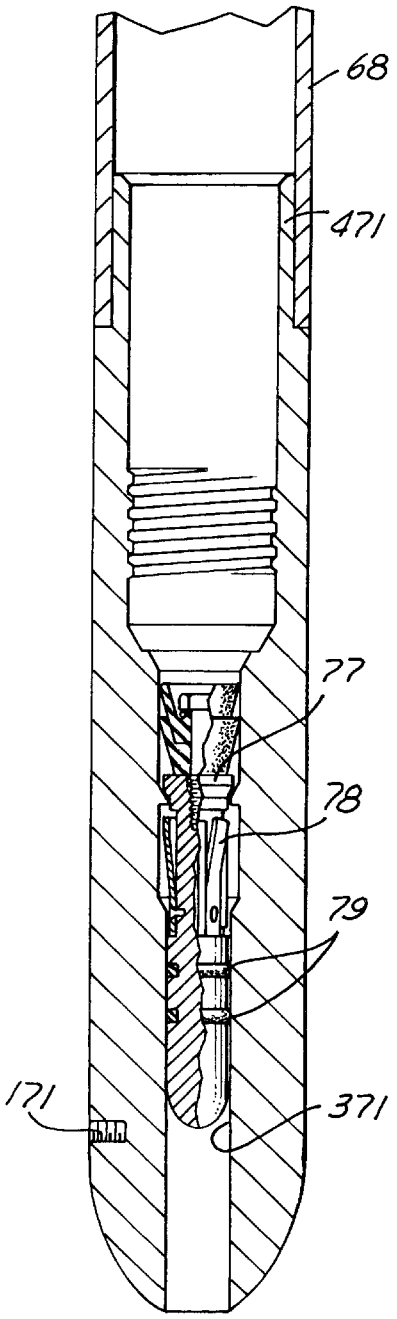
FIG. 15 is a further enlarged view of the bottom shoe of the liner as it appears after the liner has been advanced into the drilled hole and after a plug has been pumped through the liner to close the opening in the shoe.

After the hole has been drilled and assembly 20 has been withdrawn upwardly from the well, a second assembly 25 (FIG. 13) is lowered downwardly through conductor 15 to install a liner 68 in the drilled hole. In addition to liner 68, the assembly 25 includes a whipstock 70 for deflecting the liner into the drilled hole, a shoe 71 connected to the lower end of the liner, a liner hanger 72, a liner hanger running tool 73, and a string of pipe 74 which carries the other parts of the assembly and lowers them into the well and into the drilled hole and supplies fluid to these parts to assist in insertion of the liner into the hole. The liner itself is of course a tubular body containing apertures 75 in its side weall through which oil and other fluid can flow from the formation to the interior of the liner and from that liner into conductor 15 for delivery to the surface of the earth. Shoe 71 at the lower end of the liner is attached by a shear pin 171 to the upper end of whipstock 70, and contains a passage 271 through which fluid from string 74 can emit as the liner is inserted into the drilled hole. A part 171 attached to the lower end of string 74 has a releasable threaded connection 76 with shoe 71, allowing detachment of the lower end of the string from shoe 71 after the liner has been moved into position in the hole. The threaded connection at 76 may consist of left hand buttress threads adapted to be detached by right hand rotation of the string 74 relative to shoe 71, and constructed to form an easily broken joint between the parts. After the liner has been inserted in the drilled hole, a plug 77 may be pumped downwardly with the fluid through string 74 and into passage 72 to close that passage. A latch 78 locks the plug into position, and seal elements 79 of the plug positively prevent the flow of fluid in either direction through passage 72. The lower end of liner 68 may be received about an upper portion 271 of shoe 71 as shown.

Liner hangar 72 has a tubular portion 172 which projects downwardly at the angle of the drilled hole and is rigidly attached to the upper end of liner 68. The liner hanger is shaped in correspondence with the configuration of the opening 80 which is drilled in the casing by bit 23, and has a peripheral flange 81 configured to abut radially outwardly against the side wall of casing 13 entirely about that opening. Thus, the liner hanger effectively closes the opening which has been drilled in the casing except for flow of oil or other fluid through the hanger from the liner and into the casing for delivery to the surface of the earth.

Figure 16:
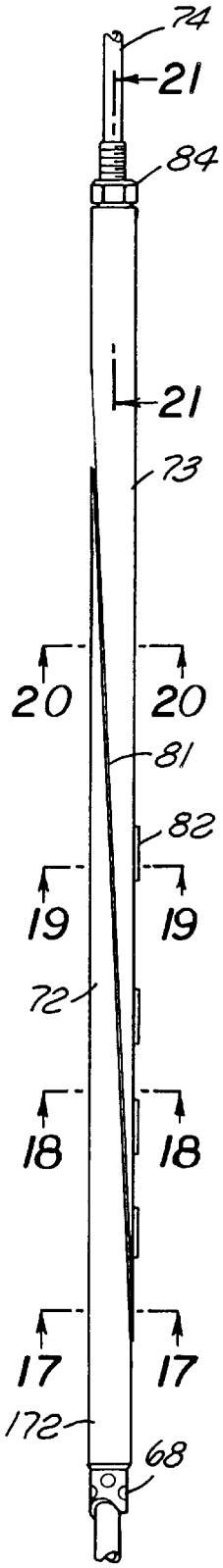
FIG. 16 is an enlarged view of the portion of the apparatus enclosed within the area defined by the broken lines identified by the number 16 in FIG. 13.
Figure 17:
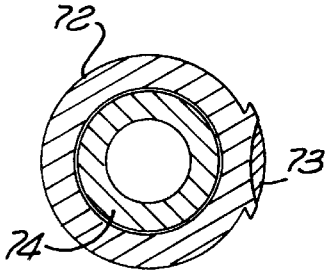
FIGS. 17 through 20 are horizontal sections taken on lines 17—17, 18—18, 19—19 and 20—20 respectively of FIG. 16.
Figure 18:
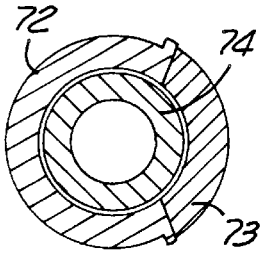
Figure 19:
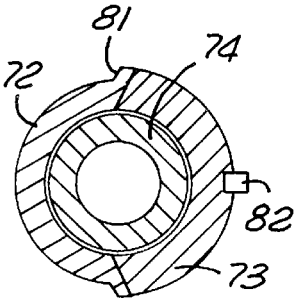
Figure 20:
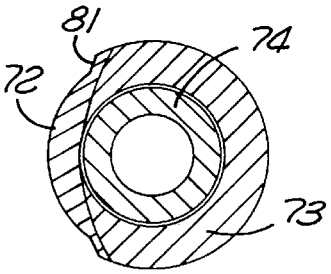
Figure 21:
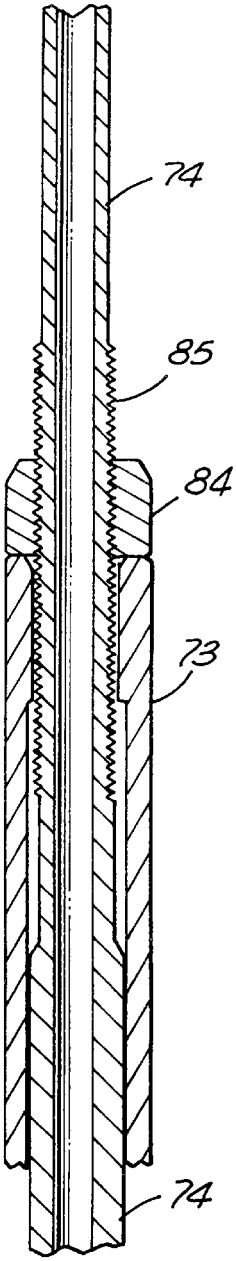
FIG. 21 is an enlarged fragmentary vertical section taken on line 21—21 of FIG. 16.
Figure 22:
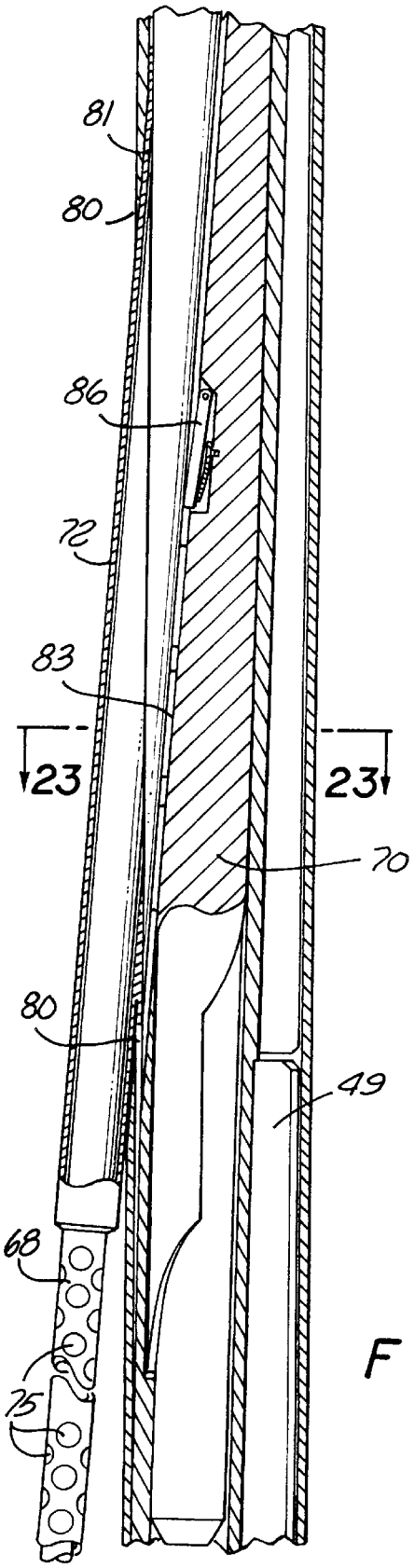
FIG. 22 is a fragmentary vertical section showing the liner hanger deflected into the opening in the side wall of the casing.
Figure 23:
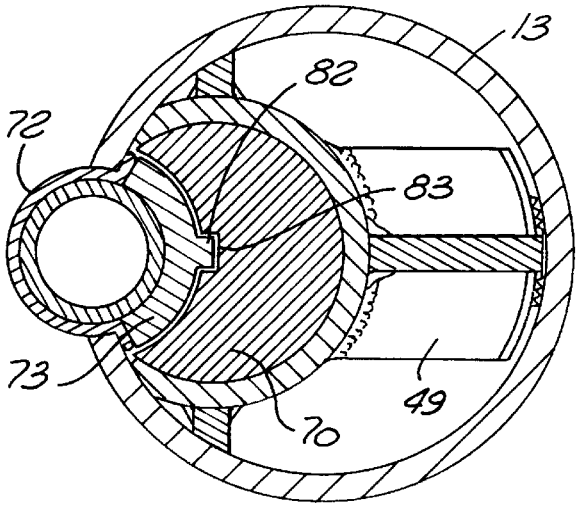
FIG. 23 is an enlarged horizontal section taken on line 23—23 of FIG. 22.

The liner hanger running tool 73 extends partially about string 74 as illustrated in FIGS. 16 through 18, and is engageable with flanges 81 of the liner hanger to press those flanges tightly against the inner surface of the casing. Alignment lugs 82 on running tool 73 are received within a groove 83 in whipstock 70 to maintain the running tool and hanger in a position in which the hanger will properly advance into the drilled opening in the casing as the parts are lowered. The upper edges 170 of the whipstock curve helically to form camming surfaces which are engageable by the lowermost one of the alignment lugs 82 as the hanger running tool moves downwardly relative to the whipstock, and which cam that lug 82 rotatively into the upper end of groove 83, to thereby automatically rotate the liner hanger and its running tool to a proper position for advancing the hanger into the drilled hole in the casing.

The radial thickness of the running tool gradually decreases in a downward direction as shown in the figures, to properly locate the hanger in the casing wall opening. As will be apparent from the drawings, the entire assembly 25 is dimensioned for reception within conductor 15 as the assembly is lowered downwardly to the bottom of the well. During such lowering, the liner hanger running tool is retained at its upper end by a nut 84 connected threadedly onto a tubular part 85 forming a portion of the string 74 by which the assembly is suspended. Thus, the liner, liner hanger and liner hanger running tool may be considered as being effectively clamped between shoe 71 at the lower end of string 74 and nut 84 at the upper end of the running tool. When the string 74 and liner hanger running tool are eventually pulled upwardly from the well, an upper one of the alignment lugs 82 of the running tool engages a spring pressed latch element 86 attached pivotally to the whipstock in a relation applying upward force to that latch element and through it to the whipstock to thereby pull the whipstock upwardly from the well with the other parts.

To now describe briefly a cycle of operation of the disclosed apparatus, assume that the well 10 has become depleted after producing oil or other fluid for a period of years, and that it is desired to drill a number of holes extending laterally within the producing formation. The first step is to lower conductor 15 downwardly into the well carrying anchor 16 attached by connectors 17 and 18 to the conductor. When the assembly reaches the zone at which the lateral holes are to be drilled, the operator actuates the conductor in a manner setting anchor 16 in the well, thereby locking the bottom of the conductor in place. The upper end of the conductor is held in place by slips within rotary table 90. The operator next lowers into the well the assembly 20 of FIG. 1, including whipstock 24, drilling unit 21 (including bit 23 and mud motor 121), and housing 22 about the mud motor, all suspended on tubular string 60. As the whipstock 24 reaches the lower end of conductor 15, the orienting mandrel 53 at the lower end of the whipstock moves downwardly into the tubular orienting bottom portion 54 of conductor 15, to automatically turn the whipstock to a proper position to face outwardly through opening 19 in the side of the conductor. The operator may then break shear pin 59 by applying vertical force thereto, as by suddenly releasing the weight of the string 60 to jar bit 23 downwardly relative to the whipstock. A resultant sudden decrease in the pressure of the circulating fluid in string 60 as sensed at the surface of the earth will indicate to the operator that the bit has commenced rotation and the shear pin has been broken. The string 60 is then gradually lowered while bit 23 is rotated by motor 121, and while the motor and bit are deflected gradually laterally outwardly by the whipstock, with the result that the bit drills a hole of predetermined size and shape in the casing, and then progresses outwardly into the formation. After a hole of desired length has been drilled in the formation, the rotation of the motor is stopped and the operator pulls the assembly 20 from the drilled hole and upwardly through conductor 15 to the surface of the earth. The liner assembly 25 is then lowered through conductor 15 to a position in which the lower orienting mandrel portion 53 of the whipstock moves into socket 54 in conductor 15 to rotatively orient the second whip-stock so that it faces toward the opening 19 in the side of the conductor and toward the drilled hole. After the whipstock is properly positioned, the operator abruptly releases the weight of string 74 and its suspended parts to jar these parts and break shear pin 171. Shoe 71 and the liner are thus freed for advancement past the whipstock and into the drilled hole by lowering of string 74. The liner hanger and its running tool are ultimately deflected laterally by the whipstock, to seat the liner hanger 72 into the opening formed in the casing wall. Plug 77 is then pumped downwardly through string 74 to the shoe, to close the opening in the shoe. The string 74 may then be detached from shoe 71 by right hand rotation to disconnect the threaded connection at 76, after which string 74 can be pulled upwardly from the well bringing with it the liner hanger running tool 73 and whipstock 70.

To prepare for drilling of a second hole, the operator raises and then lowers conductor 15 by hoisting equipment at the surface of the earth, and simultaneously turns the conductor through 180 degrees to a second rotary position in which the drilling and lining operations are repeated to form and line a second hole diametrically opposite the first hole. If it is desired that more than two holes be formed at the same level in a well, the J-slot type groove or recess 35 formed in the outer surface of mandrel 32 may be shaped to have three, four or more of the vertical portions 36 interconnected appropriately by inclined portions 37 and 38 so that the rotary distance between different settings of connection 18 and conductor 15 may be less than 180 degrees.

FIGS. 24 through 32 illustrate a variational form of the invention which may be identical to that shown in FIGS. 1 to 23 except as to the manner in which the lower end of the conductor is urged laterally against the side wall of the casing prior to the actual drilling operation. In FIGS. 24 through 32, the conductor is urged against the casing wall by a mechanical wedging mechanism rather than the fluid actuated pistons 47 of FIG. 4.

Figure 24:
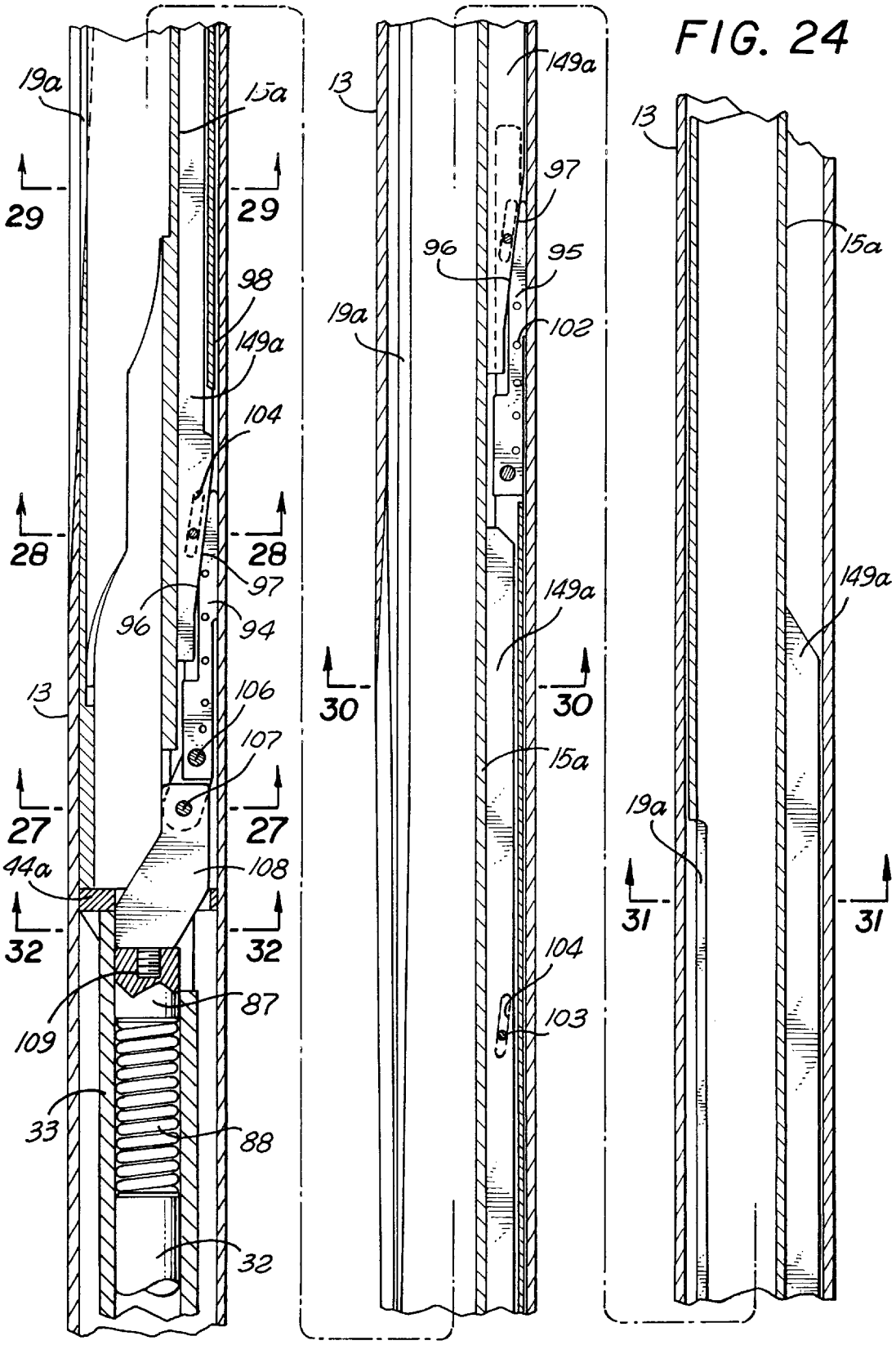
FIG. 24 is a vertical section similar to a portion of FIG. 4 and the upper portion of FIG. 3 but showing a variational form of the invention.

Referring first to FIG. 24, the tubular conductor 15*a* of this second form of the invention is in most respects the same as the conductor 15 of the first form, having a vertically elongated opening 19*a* corresponding to opening 19 of FIG. 4 to allow the drilling unit to be advanced laterally through opening 19*a* for drilling a hole through the casing and into the formation. The lower portion of the conductor is held in an eccentric position with respect to the casing by vertically elongated fins 149*a* welded to the conductor. In FIGS. 24 through 32, the fins 149*a* hold the conductor in that laterally offset eccentric position, against the side wall of the casing, through the entire vertical extent of opening 19*a* in the conductor, rather than just at the lower extremity of the conductor as in FIGS. 1 to 12. This enhances the rigidity with which the conductor is held in place relative to the casing as the hole is drilled in the casing and formation.

The rotary connection 18 at the lower end of the conductor may be the same in the FIGS. 24 through 32 form of the invention as in FIGS. 1 to 23. The upper end of the mandrel 32 of that connection 18 and the upper end of sleeve 33 are shown fragmentarily in the lower portion of FIG. 24. As in the first form of the invention, the upper extremity of sleeve 33 is welded rigidly to a horizontal circular plate 44*a*, which in turn is welded to the lower end of conductor 15*a*. A cylindrical plug 87 is received slidably within the upper portion of sleeve 33, and is movable vertically therein, with a heavy coil spring 88 being interposed vertically between the upper end of mandrel 32 and the plug. Two smaller coil springs 89 are interposed vertically between plug 87 and plate 44 to yieldingly urge the plug downwardly, with the upper ends of the springs being received and confined within recesses 93 in the plate.

Figure 25:
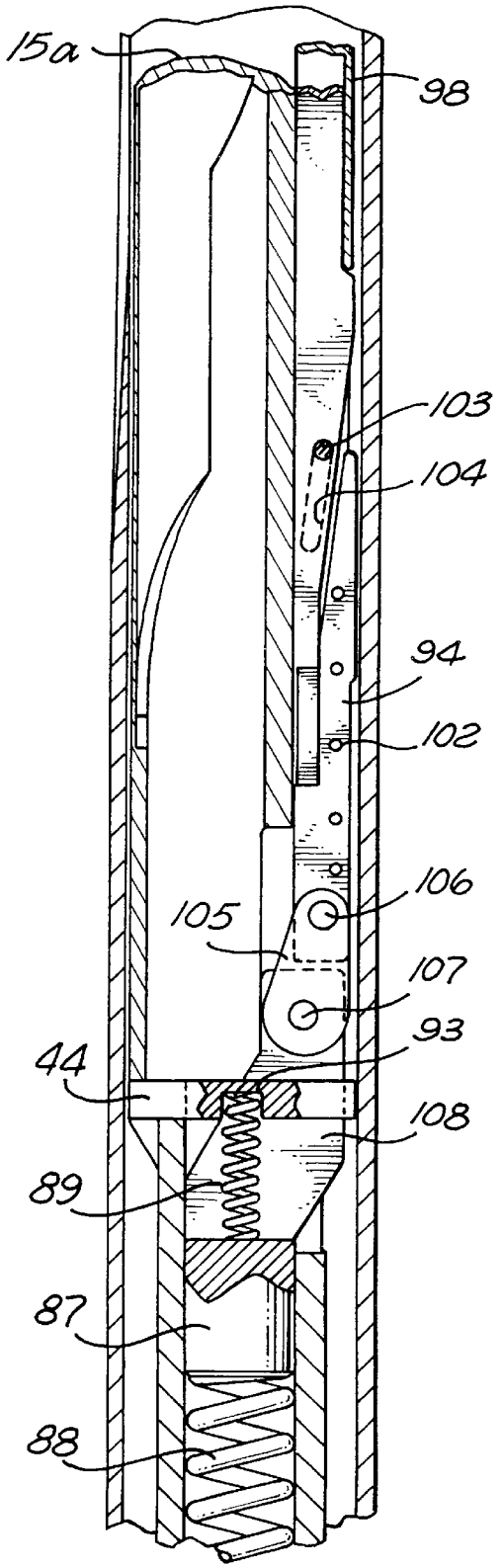
FIG. 25 illustrates fragmentarily the apparatus of FIG. 24 before the conductor has been urged laterally against the side wall of the casing.
Figure 26:
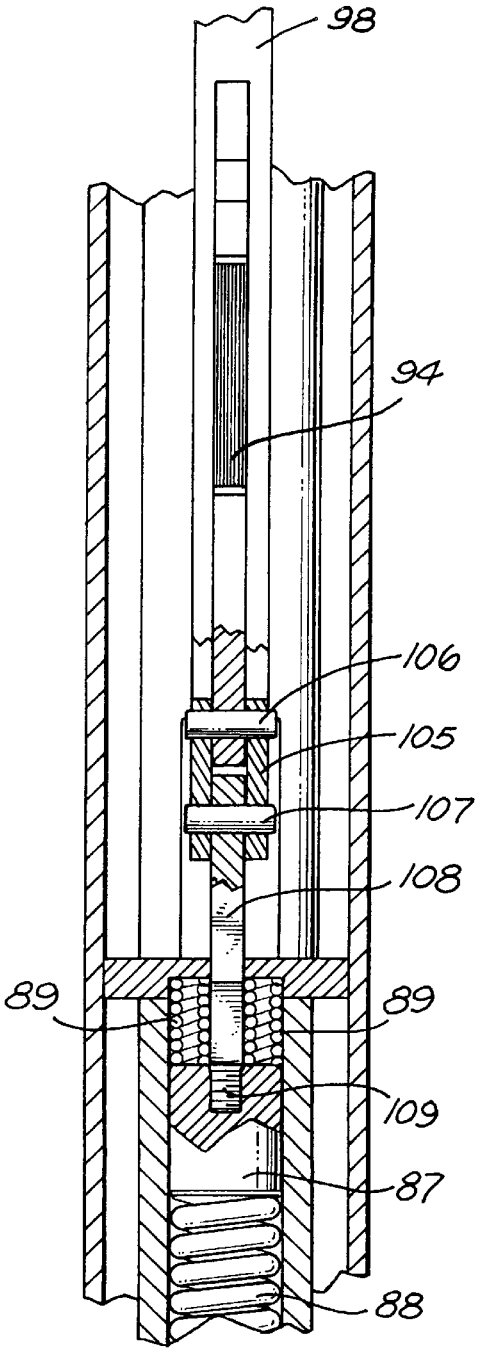
FIG. 26 is a fragmentary vertical section taken on line 26—26 of FIG. 24.
Figure 27:
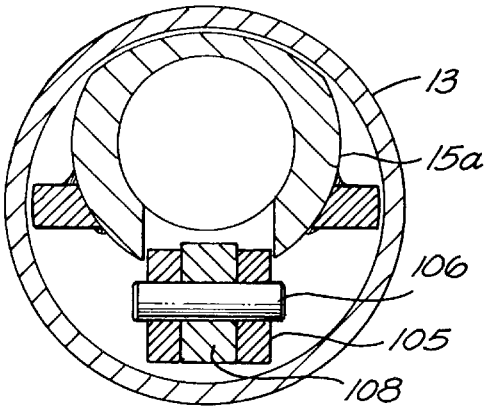
FIGS. 27, 28, 29, 30, 31 and 32 are horizontal sections taken on lines 27—27, 28—28, 29—29, 30—30, 31—31 and 32—32, respectively of FIG. 24.
Figure 28:
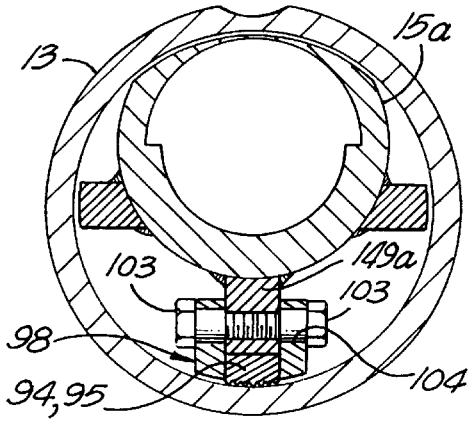
Figure 29:
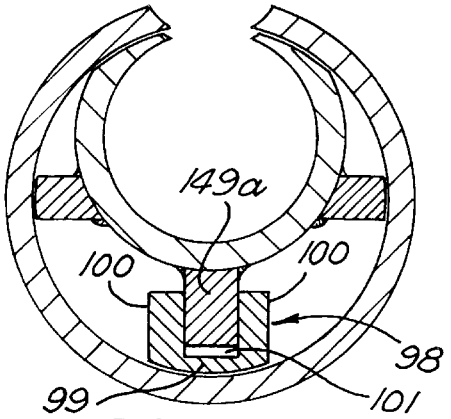
Figure 30:
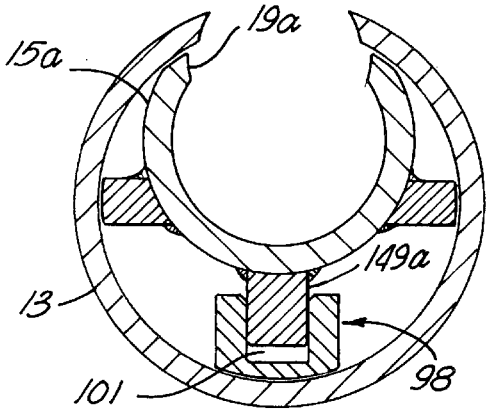
Figure 31:
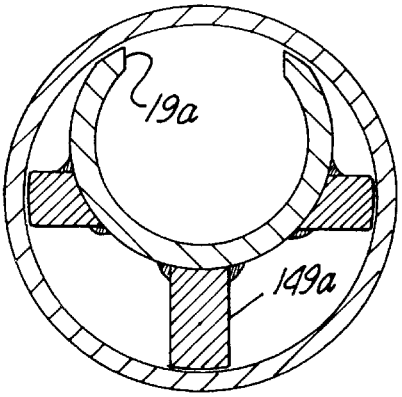
Figure 32:
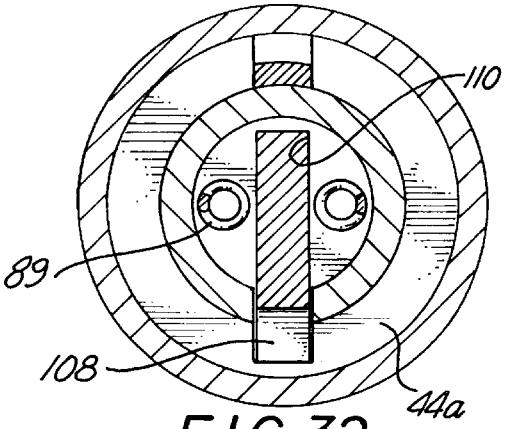

When the weight of conductor 15*a* is released from the surface of the earth sufficiently to cause downward movement of the conductor and the connected sleeve 33 relative to mandrel 32, as discussed in connection with the first form of the invention, that relative motion between sleeve 33 and mandrel 32 causes two tapering wedge elements or slips 94 and 95 to cam conductor 15*a* laterally, in a leftward direction as viewed in FIGS. 24 and 25, against the side wall of the casing 13. As seen in FIG. 24, these wedge elements 94 and 95 have inclined cam faces 96 which advance progressively in a rightward direction as they advance upwardly in FIG. 24, and which engage correspondingly inclined cam faces 97 formed on the radially outer surface of one of the fins 149*a* located diametrically opposite the opening 19*a* in conductor 15*a*. Elements 94 and 95 are rigidly attached to a vertically extending channel shaped part 98 which along most of its vertical extent has the horizontal cross sectional configuration illustrated in FIGS. 29 and 30, including a radially outer wall 99 and two opposite side walls 100. Fin 149*a* is confined and located within the recess formed in part 98, with a space 101 between fin 149*a* and the outer wall 99 of part 98 to allow limited movement of fin 149*a* and the connected conductor 15*a* relative to part 98 in a left to right direction as viewed in FIG. 24. As best seen in FIG. 28, the outer wall 99 of part 98 is interrupted at the locations of wedge elements 94 and 95 to allow those elements to engage directly against the casina and thus cam the conductor leftwardly in FIG. 24 relative to the casing. Elements 94 and 95 may be attached rigidly to part 98 in any convenient manner, as for instance by provision of a number of bolts 102 extending through parts 94 and 95 and the side walls 100 of part 98. The assembly 94, 95, 98 is attached movably to fin 149*a* by a number of pins 103 (FIG. 28), which are connected threadedly to fin 149*a* and are received slidably within inclined slots 104 formed in the side walls 100 of part 98. These slots 104 are disposed at an inclination corresponding to the inclination of cam surfaces 96 and 97, to allow the conductor to move laterally relative to wedging elements 94 and 95 as the conductor and wedging elements move vertically relative to one another.

At its lower end, the bottom wedge element 94 is connected pivotally to a pair of links 105 by a horizontal pin 106, with the lower ends of the links being connected pivotally by a second horizontal pin 107 to a part 108 having a threaded lower extremity 109 connected threadedly into the previously mentioned plug 87. Part 108 may be rectangular in horizontal section, and be received within a rectangular opening 110 in bottom plate 44*a* of the conductor, with part 108 being movable vertically relative to the plate within opening 110. Plug 87 and the connected parts, including wedge elements 94 and 95, are normally urged downwardly to the FIG. 25 retracted positions of the wedge elements by the previously mentioned coil springs 89 above the plug.

In conducting a drilling operation with the apparatus of FIGS. 24 through 32, the conductor is lowered in the well in the same manner described in connection with the first form of the invention, with anchor 16 and connections 17 and 18 at the lower end of the conductor. When the apparatus reaches the zone at which lateral holes are to be drilled, the operator sets anchor 16 to lock it in place in the well, and then allows the weight of the conductor to move the conductor and the connected plate 44, and sleeve 33 of connection 18, downwardly relative to mandrel 32. Parts 94, 95, 98, 105, 108, and 87 tend to move downwardly with the conductor, but with that movement being resisted by coil spring 88. As the coil spring 88 and springs 84 compress from the condition of FIG. 25 to the condition of FIGS. 24 and 26, the conductor is allowed to advance a short distance downwardly relative to wedge elements 94 and 95, causing those elements to bear rightwardly against the casing wall and leftwardly against fin 149*a* attached to the conductor, and thereby cam the left side of the conductor tightly against the casing wall. The conductor is thus held rigidly in fixed position relative to the casing along the entire vertical extent of opening 19*a* in the conductor, and entirely about that opening. The drilling unit and whipstock may then be lowered into the conductor to perform the drilling operation in the same manner discussed in connection with the first form of the invention. The drilled hole may be lined in the manner previously described, after which a second hole may be drilled and lined, with the conductor then being detached from the anchor and withdrawn from the well.

While certain specific embodiments of the present invention have been disclosed as typical, the invention is not limited to these particular forms, but rather is applicable broadly to all such variations as fall within the scope of the appended claims.

I claim:

1. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be lowered through said tubular conductor from near the surface of the earth to said zone and be located at said zone;

a drilling unit adapted to be deflected by said whipstock in a lateral direction from within the conductor into the earth about the conductor to form a hole therein; and a connection for attaching said whipstock to a lower portion of the tubular conductor to hold the whipstock in position within the well by such connection to the tubular conductor while the drilling unit is being deflected laterally by the whipstock.

2. Apparatus as recited in claim 1, including an anchor at the lower end of the conductor for holding the conductor in place in the well.

3. Apparatus as recited in claim 1, including a connection attaching the whipstock to the drilling unit to be lowered therewith into the tubular conductor, and enabling advancement of the drilling unit past the whipstock to drill said hole.

4. Apparatus as recited in claim 3, including a tubular housing containing at least a portion of said drilling unit and lowerable into the well with the whipstock and drilling unit and from which the drilling unit is advanceable downwardly for deflection laterally by the whipstock.

5. Apparatus as recited in claim 1, including an anchor at the lower end of the conductor engageable with a wall of the well to hold the conductor in place in the well, and a connection between the tubular conductor and anchor enabling the conductor to be turned relative to the anchor to a changed position for holding a whipstock in a position to deflect a drilling unit in a second lateral direction to drill a second hole in that second direction.

6. Apparatus as recited in claim 1, in which said tubular conductor has an opening formed in a side wall thereof before lowering of the conductor into the casing and through which the drilling unit is deflectable laterally into the earth.

7. Apparatus as recited in claim 6, in which said conductor is adapted to be turned after drilling of said hole to a changed position for holding a whipstock facing in a second lateral direction to deflect a drilling unit for drilling a second hole in the earth in said second direction.

8. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone; and a drilling unit adapted to be deflected by said whipstock in a lateral direction from within the conductor into the earth about the conductor to form a hole therein;

said drilling unit and said whipstock being adapted to be lowered through said tubular conductor to said zone after the conductor has been lowered to said position in the well.

9. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

first orienting means carried by the conductor near said zone; and second orienting means lowerable with said whipstock into engagement with said first orienting means in a relation orienting the whipstock rotatively relative to the conductor.

10. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

first orienting means carried by the conductor near said zone; and second orienting means lowerable with said whipstock into engagement with said first orienting means in a relation orienting the whipstock rotatively relative to the conductor;

said conductor being adapted to be turned in the well, after drilling of said hole, to a changed position for holding a whipstock in a position to deflect a drilling unit in a second lateral direction to drill a second hole in that second direction.

11. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

said tubular conductor having opening formed in a side wall thereof for lowering of the conductor into the casing and through which the drilling unit is deflectable laterally into the earth;

first orienting means carried by the conductor near said zone; and second orienting means lowerable with said whipstock into engagement with said first orienting means in a relation orienting the whipstock rotatively relative to the conductor for deflection of the drilling unit through said opening in the side wall of the conductor in drilling said hole.

12. Apparatus as recited in claim 11, including an anchor at the lower end of the conductor engageable with a wall of the well to hold the conductor in place in the well, and a rotatively adjustable connection between the anchor and tubular conductor enabling the conductor to be turned relative to the anchor to different positions in which a whipstock held by the conductor can deflect a drilling unit in different lateral directions.

13. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

an anchor at the lower end of the conductor engageable with a wall of the well to hold the conductor in place in the well; and a detachable connection between the tubular conductor and said anchor enabling the tubular conductor to be detached from the anchor and withdrawn upwardly from the well.

14. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

an anchor at the lower end of the tubular conductor, adapted to be lowered into the well with the conductor and anchor the lower end of the conductor;

a detachable connection between the anchor and the tubular conductor enabling the conductor to be separated from the anchor and withdrawn upwardly from the well; and a rotatively adjustable connection between the anchor and conductor permitting turning of the conductor to different rotary settings for drilling holes in different lateral directions.

15. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

said tubular conductor having an external diameter substantially smaller than the internal diameter of said casing; and means for holding a lower portion of the tubular conductor containing said whipstock in an eccentric position with respect to the casing offset in said lateral direction toward a side of the casing.

16. Apparatus as recited in claim 15, in which said means are operable by fluid pressure developed by the weight of said tubular conductor to urge said lower portion of the tubular conductor in said lateral direction toward said eccentric position.

17. Apparatus as recited in claim 15, in which said means include wedge means actuable to cam the lower portion of the conductor laterally.

18. Apparatus as recited in claim 15, in which said drilling unit is operable to drill a hole in the casing as the drilling unit is deflected laterally by the whipstock, said means being operable to hold said lower portion of the conductor laterally against said side of the casing through substantially the entire vertical length of said hole drilled in the casing.

19. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein; and a liner adapted to be lowered through said conductor and to be advanced laterally from within the conductor into said hole in the earth.

20. Apparatus as recited in claim 19, including a liner hanger lowerable through said conductor and adapted to be seated in a hole formed in said casing by said drilling unit.

21. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

a liner adapted to be lowered through said conductor and to be advanced laterally from within the conductor into said hole in the earth; and a second whipstock to be lowered into the tubular conductor and deflect said liner laterally into said hole in the earth.

22. Apparatus as recited in claim 21, including a liner hanger lowerable through said conductor with the liner and adapted to be deflected by the second whipstock and seated thereby in a hole formed in said casing by said drilling unit.

23. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

an anchor at the lower end of said conductor for retaining said lower end of the conductor in place in the well;

a rotatively adjustable connection between the anchor and the conductor enabling the conductor to be turned between different positions for drilling different holes into the earth in different lateral directions; and two liners adapted to be lowered through said conductor and into said different holes.

24. Apparatus as recited in claim 23, including a liner whipstock lowerable into the tubular conductor and adapted to deflect said liners into said holes.

25. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

said drilling unit being carried by a string having a non-circular cross section enabling it to bend more readily in one direction than in a second direction; and a non-circular opening through which said string advances slidably to retain the drilling unit in a predetermined rotary orientation controlling the direction in which the drilling unit and string curve outwardly into the formation.

26. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

a liner to be lowered through said conductor and laterally into said hole in the earth having a shoe at its lower end containing an opening; and a plug lowerable into the liner and adapted to close said opening in the shoe.

27. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein;

a liner to be lowered through said conductor and laterally into said hole in the earth and a liner hanger connected to said liner; and a liner hanger running tool lowerable with the liner and liner hanger and adapted to set the hanger in a hole in the casing;

the running tool being detachable from the liner and hanger for removal from the well.

28. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be held by the tubular conductor near said zone;

a drilling unit adapted to be deflected by said whipstock in a lateral direction from within the conductor into the earth about the conductor to form a hole therein; and a tubular string lowerable into the conductor and having a liner disposed thereabout with a shoe at its lower end connected to the lower end of the string and detachable therefrom to allow removal of the string from the well without the liner.

29. Apparatus as recited in claim 28, in which said string carries a liner hanger, a whipstock for deflecting the liner into said hole in the earth, and a liner hanger running tool for setting the hanger in a hole in the casing, said liner deflecting whipstock and running tool being connected to the string for removal from the well therewith.

30. Apparatus for enhancing production from a well having a casing extending downwardly toward a zone spaced beneath the surface of the earth, comprising:

a tubular conductor having an opening in its side wall and adapted to be lowered into said casing to said zone;

an anchor at the lower end of said conductor for holding the conductor in place in the well;

a drilling unit to be lowered through said conductor to said zone;

a whipstock connected to the drilling unit to be lowered therewith into the well and adapted to deflect the drilling unit laterally to drill a hole in said casing and into the earth formation;

a tubular housing connected to the upper end of the whipstock and containing at least a portion of the drilling unit and from which the drilling unit advances downwardly to pass and be deflected by the whipstock;

first orienting means carried by said conductor;

second orienting means carried by the whipstock engageable downwardly against said first orienting means to orient the whipstock facing outwardly through said opening in the side wall of the conductor;

a liner to be advanced downwardly through said coductor and laterally outwardly into said hole in the formation; and a detachable connection between said conductor and said anchor enabling removal of the conductor from the well without the anchor.

31. Apparatus as recited in claim 30, including a rotatively adjustable connection between said anchor and said conductor enabling the conductor to be turned to a changed rotary setting for drilling a hole in said casing and formation in a second lateral direction, and a second liner to be lowered through the conductor and into said hole extending in said second lateral direction.

32. Apparatus as recited in claim 31, including a second whipstock lowerable into the conductor for deflecting said liners into said holes, and liner hangers to be seated in said holes in the casing.

33. Apparatus comprising:

a drilling unit to be lowered into a well having a casing and adapted to drill a hole through the side wall of said casing and into the earth formation;

a liner to be advanced through said hole in the casing and then into the formation; and a liner hanger for conducting fluid from the liner into the casing and constructed to fit in said hole in the casing and engage the casing wall essentially about said hole.

34. Well drilling apparatus comprising:

a drilling unit to be lowered into a well;

a whipstock for deflecting said drilling unit laterally to drill a hole in the earth formation;

a string supporting said drilling unit and having a portion with a non-circular cross section enabling it to bend more readily in one direction than in a second direction; and means forming a non-circular opening through which said string advances slidably to retain the drilling unit in a predetermined orientation controlling the direction in which the drilling unit and string curve outwardly into the formation.

35. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be lowered through said tubular conductor from near the surface of the earth to said zone;

a drilling unit adapted to be deflected by said whipstock in a lateral direction from within the conductor into the earth about the conductor to form a hole therein; and a connection for attaching said whipstock to a lower portion of the tubular conductor to hold the whipstock in position within the well by such connection to the tubular conductor while the drilling unit is being deflected laterally by the whipstock.

36. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a drilling unit;

a whipstock to be lowered with the drilling unit through said tubular conductor from near the surface of the earth to said zone;

said drilling unit being adapted to be deflected by said whipstock in a lateral direction from within the conductor into the earth about the conductor to form a hole therein; and a connection for attaching said whipstock to a lower portion of the tubular conductor to hold the whipstock in position within the well by such connection to the tubular conductor while the drilling unit is being deflected laterally by the whipstock.

37. Apparatus for enhancing production from a well having a casing extending downwardly toward a zone spaced beneath the surface of the earth, comprising:

a tubular conductor to be lowered into said casing to a position in which the conductor extends downwardly from near the surface of the earth to said zone beneath the surface;

a whipstock to be located at said zone; and a drilling unit adapted to be deflected by said whipstock in a lateral direction from within the conductor into the earth about the conductor to form a hole therein;

said whipstock being dimensioned and constructed for removal upwardly from the well through said tubular conductor after drilling of said hole.

38. A drilling unit for drilling a hole laterally from a well, comprising:

a bit;

a vertically elongated motor adapted to drive the bit rotatively;

a whipstock connected to the drilling unit; and a vertically elongated tubular housing connected to the upper end of the whipstock and projecting upwardly thereabove and containing at least a portion of said elongated motor;

said motor being constructed for advancement downwardly from within said tubular housing and past the whipstock for deflection laterally thereby with the bit to drill a hole laterally into the earth.

* * * * *